United States Patent [19]

Ceelen et al.

[11] Patent Number: 4,801,971

[45] Date of Patent: Jan. 31, 1989

[54] LIQUID CONTROL ASSEMBLY

[75] Inventors: Theodorus M. Ceelen, Laverne; Lothar Jeromin, Sierra Madre, both of Calif.

[73] Assignee: Xerox Corporation, Stamford, Conn.

[21] Appl. No.: 94,478

[22] Filed: Sep. 8, 1987

[51] Int. Cl.[4] ..... G03G 21/00

[52] U.S. Cl. ..... 355/10; 355/15; 15/102

[58] Field of Search ..... 355/10, 15; 15/100, 15/256.5, 102; 118/652, 659, 660

[56] References Cited

U.S. PATENT DOCUMENTS 3,422,479 1/1969 Jeffee ..... 15/100

3,766,593 10/1973 Becker et al. ..... 355/15 X 4,624,544 11/1986 Jeromin ..... 355/3 R

*Primary Examiner*—Arthur T. Grimley

*Assistant Examiner*—J. Pendergrass

*Attorney, Agent, or Firm*—Robert E. Cunha

[57] ABSTRACT

In a liquid toner xerographic system, a sheet of matted polyester is held against the back of the selenium xerographic plate as it passes the transfer station to absorb the toner on the back and leading and trailing edges of the plate. The material is supplied by supply and take up rolls and is advanced a predetermined amount for each passage of the plate. The material is located above the transfer station to clean the transfer wiper in the absence of a plate.

4 Claims, 5 Drawing Sheets

LIQUID CONTROL ASSEMBLY

BACKGROUND OF THE INVENTION

This invention is a wick assembly for cleaning excess liquid toner from a xerographic plate, the mechanism comprising a sheet of wicking material fed from a roll and wiped across the back of the plate to absorb excess toner.

In a xerographic liquid development system, liquid toner must be transferred from the development fountain to the xerographic plate, and from there to the paper to form an image. However, in addition to the image toner, there is always excess toner which is transferred to the working surface, sides and back of the plate. This toner, if not removed, will spread around the interior of the cabinet by the numerous mechanical devices, making the interior unsightly, and leading to a mechanical and electrical lack of reliability.

There are three main reasons for excess toner being present in the cabinet. One is that the top of the standing wave of toner at the fountain is higher than the lower surface of the plate, so that as the leading and trailing edges of the plate pass over the fountain, some toner is deposited on the top of the plate. Second, in this system the transfer of toner from the plate to the paper is accomplished under pressure, the pressure being applied by a flexible transfer wiper which scrapes along the bottom of the paper as it advances, along with the plate, through the transfer station. As the trailing edge of the paper passes the transfer line, some toner may be squeezed out from under the trailing edge of the paper. Finally, as the trailing edge of the plate passes the wiper, the edge of the wiper will snap up to its rest position, possibly throwing toner into the interior of the cabinet.

What is required is a cost effective apparatus for removing this excess toner.

SUMMARY OF THE INVENTION

This invention provides a sheet of matted (not woven) polyester material which is held in place against the back, or upper, surface of the plate as it passes the transfer station. The sheet is held in place by a thick layer of compressible polyethelene foam on a roll which forces the wicking material to wipe along the back (top) of the plate to remove any toner. As the leading and trailing edges of the plate contact the sheet, the foam tends to conform to remove toner from these edges, and after the plate passes the transfer point, the sheet contacts the transfer wiper, absorbing the toner left there. The result is that this single sheet of wicking material, positioned as it is above the plate, absorbs practically all of the excess toner without intereferring with the transfer operation.

To continually keep a clean area of the sheet at the point of contact with the plate, the sheet of wicking material is supplied on a supply roll, and passes over two compressible foam rolls before being taken up by a take-up roll. As the plate passes the transfer station the take-up roll is advanced a predetermined amount by the action of a gear train, pawl and rachet to advance the sheet. There is sufficient material on the roll to last for 6,000 images.

DETAILED DESCRIPTION OF THE INVENTION

U.S. Pat. No. 4,624,544, Automatic Xerographic Plate Development System by Lothar S. Jeromin describes a xerographic system in which this invention can be used, and is incorporated herein by reference. In that patent the exposed plate is transported on an upper track 15 from right to left, drops through to the lower track 16, and then proceeds past development, transfer and drying stations from left to right.

Figure 1A:
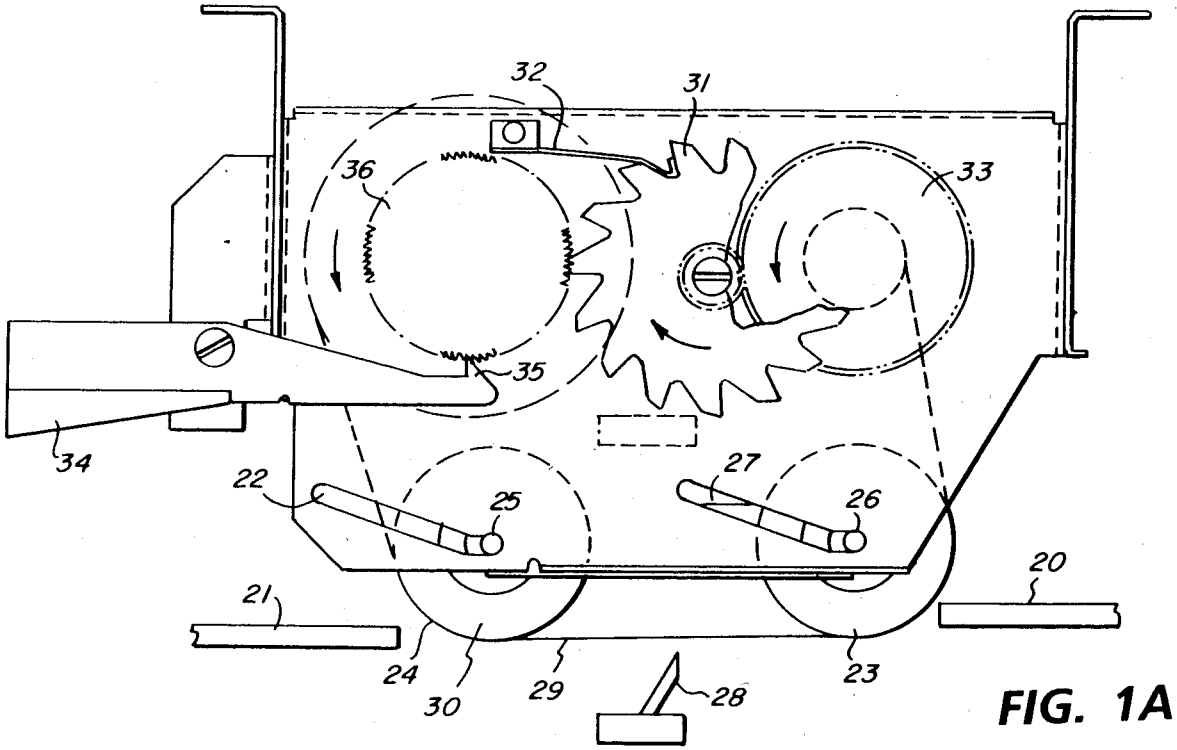
FIG. 1A is a side view of the liquid control assembly.

FIG. 1A is an end view of the liquid control assembly. As the plate is traveling from right to left on the upper track, the plate is approximately one half an inch higher than it is when traveling on the lower track from left to right. The plate in its higher position is shown in FIG. 1A as plate 20. As the plate travels to the left it contacts the rolls 23,24, forcing them to the left. The rolls are free to slide on pins 25 26 in slots 22 27 which forces the rolls upward, out of the path of travel of the plate. The plate 20 is also high enough so that it will not contact the wiper 28.

A pin is mechanically coupled to the plate and is positioned so that it will contact the lower portion of the rachet 31, driving the rachet one step in the clockwise direction. Pawl 32 is attached to the housing at its left end and is made from spring material, allowing the rachet 31 to advance one step in the clockwise direction but preventing the rachet from returning in the counter clockwise direction. This rachet is geared down, 4 to 1, to drive gear 33 which is attached to the take-up roll, advancing the wicking material 29.

This occurs at a time when the rolls 23 24 are positioned up and to the left by the action of the plate 20 forcing the rolls upward in their respective slots. Therefore the wicking material path is momentarily shortened, resulting in some slack which is partially taken out by the advancement of the take up roll. As the trailing edge of the plate continues past roll 24, both rolls fall to their lower positions. The material is now under tension because of the shortening of the wicking material by the action of the take up roll.

Next, as the plate travels to the left, the pin contacts the lower cam surface of the arm 34 which forces the contact point 35 of the arm out of contact with the rachet 36. This rachet 36 is connected to the supply roll so that the supply roll is free to supply a length of wicking material to relieve the tension. The supply roll is prevented from freewheeling, and supplying too much material, by a friction member to be described below.

As the plate 21 returns from the left, it is now is on the lower track and contacts the cleaning roll 24 which is covered by the wicking material 29. Since the pin 25 is already at the right end of its range, it must remain in this position. Therefore the polyethelene layer 30 deforms to conform to the leading edge of the plate and then to the upper surface of the plate. The second roll 23 is positioned 80 thousandths of an inch higher than the first roll 24. Therefore, practically all of the cleaning is accomplished at the first roll 24.

Figure 1B:
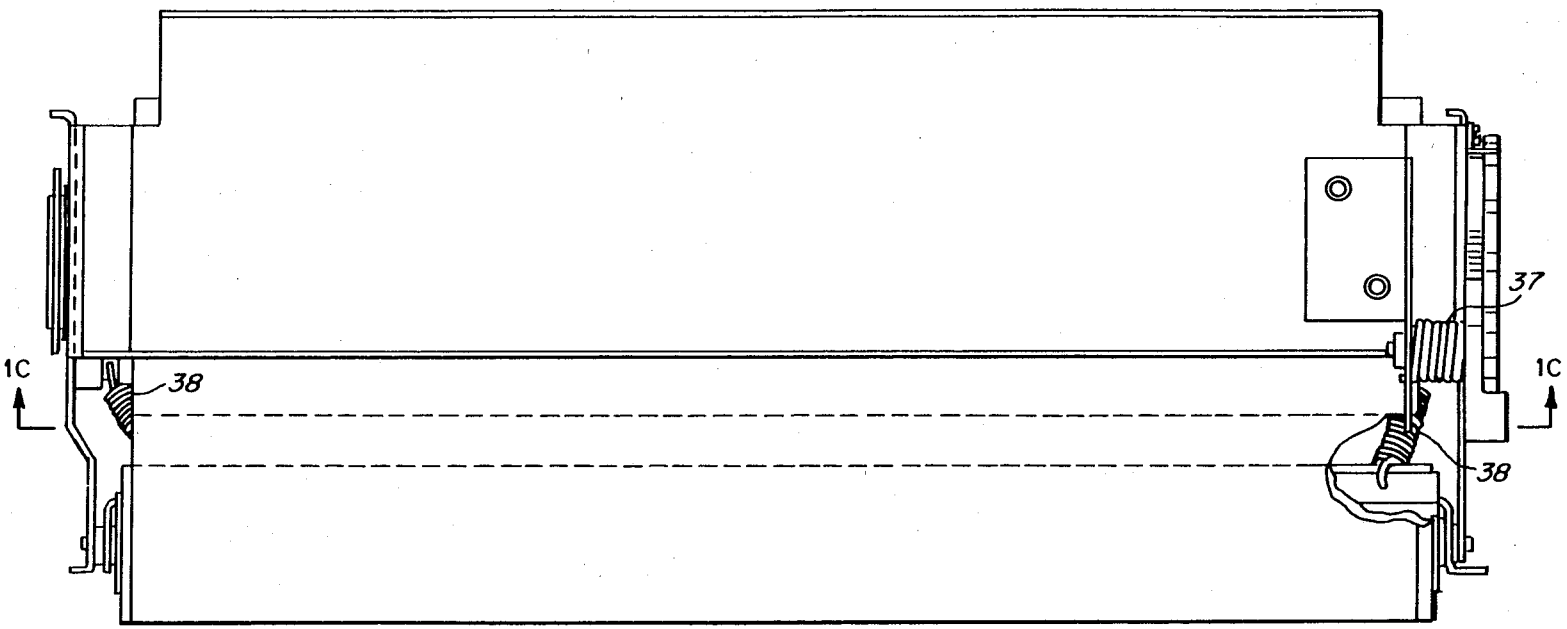
FIG. 1B is a front view of the liquid control assembly.

FIG. 1B is a front view of the assembly, showing a spring 37 which biases the arm 34 in the counterclockwise position and two springs 38 which bias the member on which rolls 23 and 24 are mounted to their lower position.

Figure 1C:
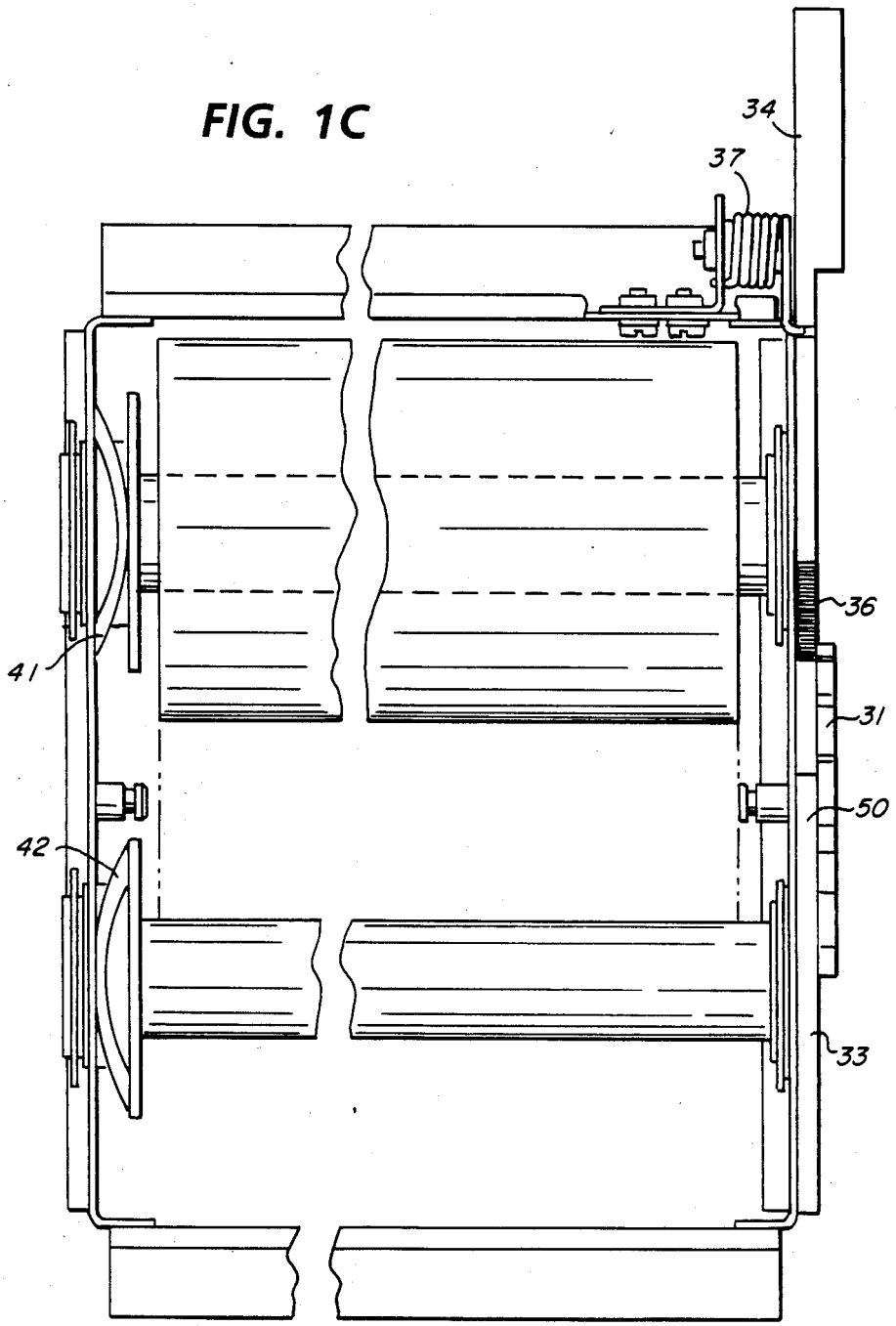
FIG. 1C is a view of a section of FIG. 1B.

Section A—A of FIG. 1B is shown as FIG. 1C which shows a take up roll 40 and a supply roll 39 with a full roll of wicking material. This view also shows the arm 34, the arm spring 37, rachets 36 and 31 and an inner gear 50 attached to the rachet 31 which meshes with the gear 33 attached to the take up roll 40. The take up and supply rolls 39, 40 are prevented from free wheeling by friction rings 41, 42. Two sided tape is used to attach the material 29 to the rolls 39, 40.

Figure 2A:
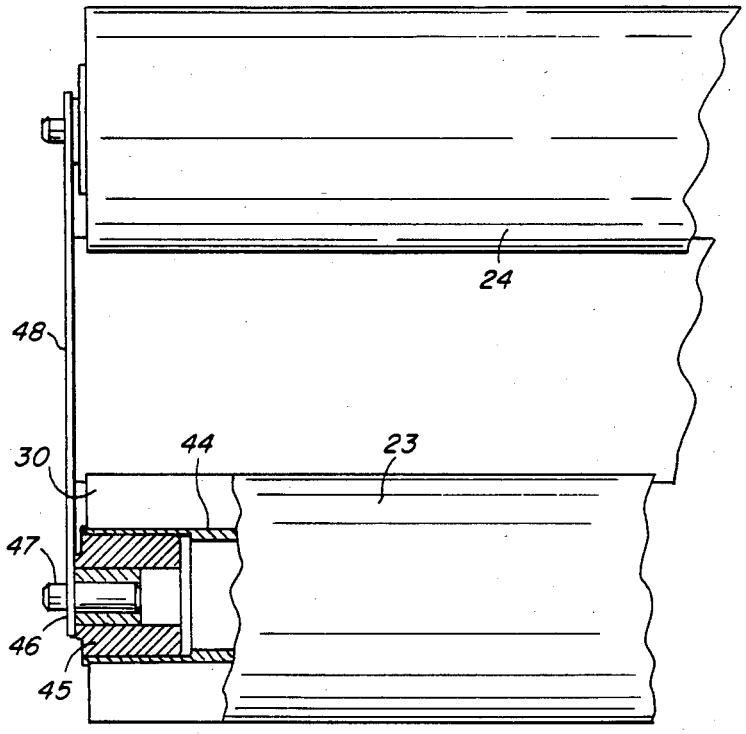
FIGS. 2A and 2B show the cleaning rolls and connecting bracket.
Figure 2B:
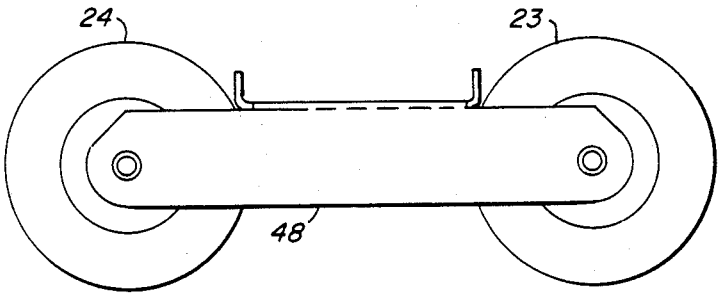

FIG. 2A shows the cleaning rolls 23, 24 which are identical. There is a layer of polyethelene 30 attached with hot melt glue over an aluminum core 44. A plastic insert is forced into the hollow core and a pin assembly 46 is force fitted into the insert. The pin assembly comprises an outer shell containing a pin 47 and a spring, not shown, which biases the pin outward. The rolls 23,24 are connected by a bracket 48 which is shown as section A—A in FIG. 2B.

Figure 3A:
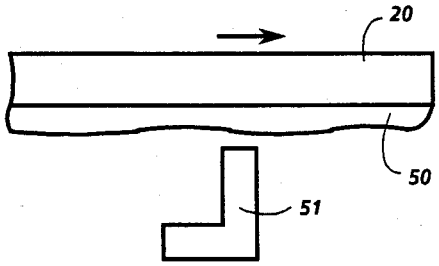
FIGS. 3A, 3B and 3C show the effect of the pretransfer corotron on the film of toner on the plate prior to transfer.
Figure 3B:
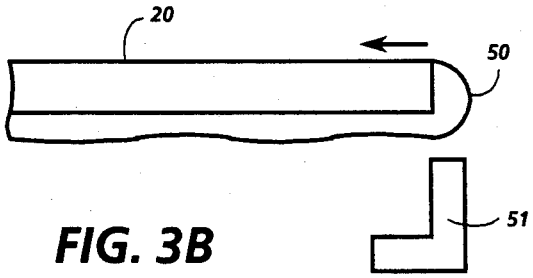
Figure 3C:
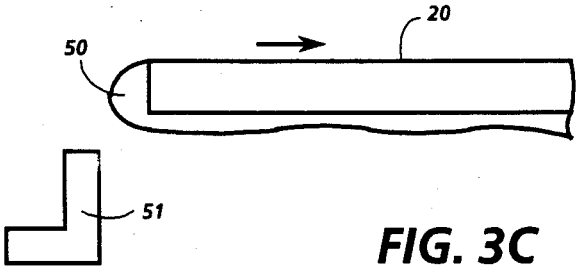

The reason why there typically is at least some toner on the leading and trailing edges of the plate just prior to transfer is shown in FIGS. 3A, 3B and 3C. As shown in FIG. 3A, after passing the fountain, the plate 20 will have a film of toner 50. To guarantee that the toner will be spread to the edges of the plate, the plate continues past the pretransfer corotron 51 until the right edge of the plate is approximately 5 cm past the corotron, at which time the corotron current is turned on. The plate now reverses direction, proceeding to the left until it is at the position shown in FIG. 3B. Since the corotron and the toner are both charged positively, there is a repelling force between them, tending to drive the toner to the right on the plate. The excess toner therefore will tend to be driven up onto the right, or leading, edge. Then the plate direction is reversed driving the plate to the position shown in FIG. 3C. Now the toner is driven toward the left on the plate, and ultimately onto the left, or trailing, edge.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

We claim:

1. In a xerographic printer wherein a xerographic plate travels above and across a liquid toner development station for imprinting a toner image on the lower surface of said plate and then across a transfer station to transfer said image to a sheet of paper, a mechanism for absorbing excess toner from said plate after it has passed the development station comprising:

a stationary cleaning means comprising an upper resilient foam layer and a lower wicking material layer, the lower surface of said cleaning means being below the upper surface of said plate so that the lower surface of said cleaning means will wipe the leading and trailing edges and the top of said plate, and wherein said foam layer is formed into a cylindrical shape to comprise the outer layer of a cleaning roll, wherein said material is in the form of a web and wherein said cleaning means further comprises a supply roll for supplying material to, and a take up roll for receiving material from, said cleaning roll, and means for advancing said supply and take up rolls a predetermined amount during the passage of each plate past said mechanism.

2. The mechanism of claim 1 wherein said foam layer is a layer of polyethelene, and said material is polyester.

3. The printer of claim 1 wherein said cleaning means is located above said transfer station and wherein said transfer station comprises a wiper biased upward to contact said sheet of paper in the presence of said plate or to contact said material in the absence of said plate, to clean said wiper between transfers.

4. The mechanism of claim 3 wherein said mechanism comprises two cleaning rolls, the layer of material passing under both cleaning rolls to form a flat horizontal area of material.

* * * * *